United States Patent [19]

Adachi et al.

[11] Patent Number: 4,933,143

[45] Date of Patent: Jun. 12, 1990

[54] AUSTENITIC STAINLESS STEEL HAVING IMPROVED CORROSION RESISTANCE IN HOT WATER

[75] Inventors: Toshiro Adachi, Tokuyama; Atsushi Fujii, Kudamatsu; Isamu Yoshimura; Tsuguyasu Yoshii, both of Tokuyama, all of Japan

[73] Assignee: Nisshin Steel Company, Ltd., Tokyo, Japan

[21] Appl. No.: 237,786

[22] Filed: Aug. 29, 1988

[30] Foreign Application Priority Data

Sep. 2, 1987 [JP] Japan ..... 62-217963

[51] Int. Cl.[5] ..... C22C 38/42; C22C 38/44; C22C 38/34

[52] U.S. Cl. ..... 420/49; 420/50; 420/52

[58] Field of Search ..... 420/50, 49, 58, 52

[56] References Cited

U.S. PATENT DOCUMENTS 3,785,787 1/1974 Yokota et al. ..... 420/58

FOREIGN PATENT DOCUMENTS 47-31205 8/1972 Japan ..... 420/49
52-36510 3/1977 Japan ..... 420/49
59-185763 10/1984 Japan ..... 420/49

*Primary Examiner*—Deborah Yee
*Attorney, Agent, or Firm*—Webb, Burden, Ziesenheim & Webb

[57] ABSTRACT

An austenitic stainless steel having excellent corrosion resistance in hot aqueous medium is disclosed. The steel essentially consists by weight of C: not more than 0.08%
Si: 2.5–4.0%
Mn: not more than 0.8%
P: not more than 0.045%
S: not more than 0.005%
Cr: 16–25%
Ni: 6–20%
Cu: 1.5–4.0%
N: not more than 0.05% and the balance Fe and unavoidable incidental impurities.

10 Claims, No Drawings

AUSTENITIC STAINLESS STEEL HAVING IMPROVED CORROSION RESISTANCE IN HOT WATER

FIELD OF THE INVENTION

This invention relates to an austenitic stainless steel which has excellent crevice corrosion resistance and stress corrosion cracking resistance and is suitable for use in low concentration chloride environments.

BACKGROUND OF THE INVENTION

Austenitic stainless steels represented by SUS304 and SUS316 have corrosion resistance to city service water and industrial water which may contain a slight amount of chloride, and have excellent workability and weldability. Therefore, they are widely used for various kinds of water heaters, heat exchange tubes, chemical plant equipment, etc. However, they have a defect in that pitting and/or crevice corrosion occurs at welded parts, etc. at relatively high temperatures if even a slight amount of chloride ions are present, and said pitting and/or crevice corrosion may lead to stress corrosion cracking.

Prevention of stress corrosion cracking of stainless steels has been studied by many researchers and many measures for prevention thereof have been reported. But the reported effects of alloying elements vary considerably depending upon composition of test solutions, test conditions, etc. It is well known that P, Mo and N are deleterious but Cu is effective for prevention of stress corrosion cracking in low concentration chlorides environments. However, reduction of the P content to the safety level for stress corrosion cracking requires a special refining technique, which invites increase in manufacturing cost. On the other hand, Mo and N are considered to be effective for improvement of resistance to localized corrosion such as pitting and crevice corrosion.

We previously proposed in JP-B59-45751(1974) a 18Cr-9Ni steel containing a suitable amount of Cu and W, which is provided with both stress corrosion cracking resistance and crevice corrosion resistance without reduction of the P content, but this steel was not satisfactory for use at temperatures near 100° C.

In this specific field of the stainless steel technology, JP-A61-9557 (1986) (Kawasaki) discloses an austenitic stainless steel containing $C \leqq 0.0.6\%$, $Si \leqq 1.0\%$, $Mn \leqq 0.8\%$, $16\% \leqq Cr \leqq 25\%$, $6\% \leqq Ni \leqq 20\%$, $1.5\% < Cu < 2.5\%$, $0.05\% < N < 0.15\%$ and $0.2\% < Mo < 0.6\%$, wherein the S content is restricted to $<0.005\%$. The critical temperature for stress corrosion cracking resistance of this steel is around 80° C. and, therefore, nor suitable for use in hot water like our above-mentioned previously known steel.

Also JP-A59-185763 (1984) (Nippon Stainless Steel) discloses an austenitic stainless steel which contains $C \leqq 0.08\%$, $2.0\% < Si < 4.0\%$, $Mn \leqq 2.00\%$, $16.00\% \leqq Cr \leqq 20.00\%$, $8.00\% \leqq Ni \leqq 13.00\%$, $0.30\% \leqq Cu \leqq 2.00\%$, $0.05\% \leqq N \leqq 0.30\%$, $0.30\% \leqq Mo \leqq 1.50\%$, and optionally $Nb \leqq 0.10\%$, wherein the B content is restricted to not more than 0.00020%. This steel contains significantly high concentrations of N and Mo and its critical temperature for stress corrosion cracking resistance is higher than 80° C. But it is inferior in the crevice corrosion resistance.

We have further preceeded with our study and found that when stainless steel sheets are used for heat exchange apparatuses, water-heating apparatuses for instance, heat is transmitted through the used stainless steel sheets, supplied to portions susceptible to corrosion and promotes corrosion. In particular, it was learned that crevice corrosion is caused at the parts where sheets are joined by spot welding, and leads to stress corrosion cracking, and the temperature of the side of a stainless steel sheet contacting liquid, that is, the side susceptible to corrosion, reaches 100° C. or higher. Therefore, higher temperatures must be taken into consideration for prevention of stress corrosion cracking.

Under the circumstances, this invention is intended to provide an inexpensive stainless steel which is provided with resistance to crevice corrosion and does not suffer stress corrosion cracking at temperatures over 100° C.

Our detailed study on the mechanism of stress corrosion cracking and its relation to alloying elements revealed that Mo and N are strongly passivating elements which repassivate the corroded parts. But locally non-repassivated portions remain and these small portions suffer excessive corrosion because the surrounding parts are strongly repassivated. This rather makes steel more susceptible to stress corrosion cracking.

Also it was revealed that Cu, Si and Al relatively uniformly deposit on the holes of pittings or spots of crevice corrosion and inhibit dissolution of metal although very moderately. That is, these elements tend to work favorably toward prevention of stress corrosion cracking.

Further it was found that when Si contained in an amount of about 3%, the steel becomes less susceptible to stress corrosion cracking, and if Al is added, stress corrosion resistance is improved and that corrosion depth in crevice corrosion is reduced.

SUMMARY OF THE INVENTION

This invention provides an austenitic stainless steel having excellent corrosion resistance in hot water containing C:not more than 0.08%, Si:2.5–4.0%, Mn:not more than 0.8%, P:not more than 0.045%, S:not more than 0.005%, Cr:16–25%, Ni:6–20%, Cu:1.5–4.0%, N:not more than 0.05%, and optionally containing one or more of Mo:more than 0.3% and less than 1.5%, Al:0.05–3.0% and REM:0.005–0.1% according to the required corrosion resistance level, and the balance consisting of Fe and unavoidable incidental impurities.

Generally speaking, this invention has a character of an improvement of the steel of JP-A59-185763. The steel of the present invention is distinguished from said known steel in that the N content is lower and Mo, Al and REM can be contained. This characteristic will be demonstrated later.

The reason why the composition of the steel is defined as described above is as follows:

C: Carbon is a strong austenite-stabilizer and does not so adversely affect stress corrosion resistance and crevice corrosion resistance. However, it enhances intergranular corrosion sensitivity at welded parts. Therefore, the upper limit is defined as about 0.08%. The C content is preferably not more than 0.06%, and more preferably not more than 0.05%.

Si: Silicon is a necessary and important element in the steel of the present invention and improves stress corrosion cracking resistance in the presence of Cu. This is a very important element which supports the crevice-corrosion-resistance enhancing effect of Mo without hindering the stress-corrosion-cracking-resistance enhancing effect of Mo. It also has some effect to improve pitting resistance. At least about 2.5%, preferably 2.8% of Si is required therefor to exhibit the above-described effect. However, Si is a strong ferrite-former and therefore the upper limit content thereof is defined as 4% in order to minimize the required Ni content. The Si content is more preferably not less than 3.0%.

Mn: Manganese forms sulfide inclusions, which are apt to be starting points of corrosion and thus deteriorate the crevice-corrosion resistance and stress-corrosion-cracking resistance of the steel. Therefore, the lower the Mn content, the better the steel property. However, Mn is an unavoidable impurity element in steelmaking and it invites high cost in selection of row materials and operation to reduce the Mn content extremely low. The upper limit of the content thereof is defined as 0.8%, which is the content level of the inevitably involved Mn in the ordinary steelmaking. Preferably, the Mn content should be not more than 0.5% when high crevice corrosion resistance is desired because the content of Mo which is effective for the crevice corrosion resistance is limited as described below. More preferably, the Mn content is not more than 0.4%.

P: The content of phosphorus need not be lowered in particular in the steel of the present invention. However, phosphorus has adverse effect on stress corrosion cracking resistance, and, therefore, the upper limit of the content is defined as 0.045%.

S: Sulfur forms sulfide with Mn, which is deleterious for crevice corrosion resistance and stress corrosion cracking resistance. The lower the content thereof, the better the property. The upper limit is defined as 0.005%.

Cr: Chromium is an indispensable element in the stainless steel. For the stainless steel of the present invention which is used in chloride-containing hot environments, addition of at least 16% Cr is requisite. The higher the Cr content, the better the corrosion resistance. However, in order to maintain austenite phase, a greater amount of Ni is required. Also Cr impairs forgeability, rollability and workability of the steel. From consideration of these factors, the upper limit is defined as 25%. The Cr content is preferably 17–22%, and more preferably 18–20%.

Ni: Nickel is an element necessary to maintain austenite phase and at least 6% Ni is required for that purpose. On the other hand, more than 20% Ni only unnecessarily increases the cost of the steel. For this reason, the Ni content is defined as 6–20%. In this range, Ni does not particularly affect stress corrosion cracking but it is effective for improvement of crevice corrosion resistance. Therefore, Ni preferably should be contained at least in an amount of 10% for an application n which good crevice corrosion resistance is desired. The Ni content is preferably 10–18% and more preferably 12–16%.

Cu: Copper is an important element in the steel of the present invention. Cu is effective for improving stress corrosion cracking resistance of the steel in NaCl-containing hot water environment. The higher the Cu content, the greater the effect. In the steel of the present invention, Cu must be contained at least in an amount of 1.5%. The effect of Cu saturates at 4.0% and more than 4% Cu impairs the steel's hot workability. The Cu content is preferably 2–4%, and more preferably 3–4%.

N: As mentioned above, N is known to be deleterious to stress corrosion cracking resistance but effective for prevent of pitting and crevice corrosion. In the case of the present invention, Si and Cu are contained at higher levels. This enables reduction of the content of N which is deleterious in terms of stress corrosion cracking resistance and hardens the steel. In this sense, the N content is restricted to not more than 0.05%, preferably not more than 0.04% and more preferably not more than 0.03%.

Mo: Molybdenum is not an essential element in the steel of the present invention. Although Mo is very effective for improvement of crevice corrosion resistance and pitting, it impairs stress corrosion cracking resistance. In the case of the present invention, up to 1.5% of Mo can be present because of the effect of combined addition of Cu and Si (and Al). On the other hand, at least 0.3% Mo is necessary in order for it to exhibit its crevice corrosion resistance improvement effect. The Mo content is preferably 0.3–1.2% and more preferably 0.3–1.0% when contained.

Al: Aluminum improves stress corrosion cracking resistance and raises the limit temperature for stress corrosion cracking prevention in the presence of Cu and Si. Also Al reduces depth of corrosion pits in crevice corrosion. However, addition of a large amount of aluminum deteriorates hot and cold workability. Addition of 0.05–3.0% is proper. Preferred amount is 0.1–2.0% and more preferred amount is 0.1–1.0%.

REM: Rare earth metals are effective for improvement of hot workability. In the steel of the present invention, optionally not less than 0.005% of at least one rare earth metal is added in support of the effect of Al. Throughout the description and claims the term REM means "at least one of rare earth metals". Addition of not less than 0.1% REM may increase formation of inclusions. Preferred content is 0.01–0.08% and more preferred content is 0.03–0.05%.

The stainless steel of this invention is provided with both excellent stress corrosion cracking resistance and excellent crevice corrosion resistance and these properties are realized without unduly increased in manufacturing cost. This steel is suitable as a material for apparatuses for treating hot neutral salt solutions

SPECIFIC DESCRIPTION OF THE INVENTION

Now the invention will be explained specifically by way of working examples.

Steels of the compositions indicated in Table 1 were prepared by vacuum melting and forged and hot-rolled, and thereafter cold-rolled into 1mm thick sheets by the conventional procedure.

In Table 1, Samples A1–A6 are comparative samples, wherein A1 is SUS304 and A2 is SUS316. Samples B1–B7 are steels of the present invention.

Table 2 shows the stress corrosion cracking resistance and crevice corrosion resistance of all the samples.

The stress corrosion cracking resistance was determined by the autoclave test and the heat transfer test.

The autoclave test was carried out as follows. A larger piece and a small piece were fixed together by spot welding and the thus prepared samples was placed in an autoclave containing a 50ppm $Cl^-$ solution and kept for 10 days at various temperatures. The critical temperature for stress corrosion cracking resistance was determined by checking occurrence of cracking. Also, spot-welded portions were cut out and depth of corrosion pits caused by crevice corrosion was measured. In this test, the stress corrosion cracking resistance limit temperature over 100° C. is regarded as effective.

The heat transfer surface test was carried out as follows. Against one surface of the above-mentioned spot-welded test pieces, a copper rod around which a nichrome wire was wound was held, the other surface was contacted with a 50ppm $Cl^-$ solution of 80° C. and kept for 10 days with the temperature of the surface to which heat is applied varied. Thus the critical temperature for stress corrosion cracking resistance was determined by checking occurrence of cracking. In this test, the stress corrosion cracking resistance limit temperature over around 200° C. is regarded as effective.

The crevice corrosion resistance test was carried out in accordance with the test method described in D. B. Anderson: "Statistical Aspect of Crevice Corrosion in Seawater", ASTM-STP 576, p. 231, 1976, using a 1.75% NaCl solution containing 2% $H_2O_2$ as an oxidizing reagent. Test pieces were placed in the corrosion test solution at 40° C. for 48 hours, and corrosion weight loss and number of corroded test pieces were determined.

Sample B2 which contains 2.98% Si and 0.77% Mo exhibited good stress corrosion cracking resistance (the critical temperature is 120° C. in the autoclave test and 250° C. in the heat transfer test) and high level crevice corrosion resistance. Sample B1 which contains the same level of Si as Sample B2 but do not contain a substantial amount of Mo is inferior to Sample B2 in the maximum corrosion depth and the corrosion weight loss although it has stress corrosion cracking resistance superior to Sample B2.

Samples B3 and B4 containing Al exhibits excellent stress corrosion cracking resistance (140° C. and 250° C. or therearound) as well as excellent crevice corrosion resistance although Sample B3 which substantially does not contain Mo is inferior to Sample B4 in the corrosion weight loss.

Sample B5, which substantially does not contain Mo but contains Cu and N at high levels, exhibits both good stress corrosion cracking resistance and good crevice corrosion resistance. It is understood that the effects of Cu and N are well-balanced.

Sample B6, which contains a higher level of Mo and a low level of N, is a little inferior in the stress corrosion cracking resistance although the crevice corrosion resistance is excellent.

Sample B7, which is similar to Sample B3 but contains a lower level of Al, is far better than Sample B1 although it is inferior to Sample B3 in the stress corrosion cracking resistance.

In contrast, Sample A1 and A2, which contain high levels of Mn and low levels of Si and Cu, suffered stress corrosion cracking at 80° C. (These samples did not undergo the heat transfer test.)

Samples A3 has good stress corrosion cracking resistance but inferior in the crevice corrosion resistance because the Si content is still low. Sample A4, which is similar to Sample A3 except that it contains Mo, exhibits considerably good crevice corrosion resistance but still is inferior in the stress corrosion cracking resistance, and does not reach the level of the inventive steels in the general corrosion resistance.

Sample A5 contains Mo at a level exceeding the limitation of the present invention and, therefore, is inferior stress corrosion cracking resistance. Sample A6 contains N at a level exceeding the limitation of the present invention and, therefore, it suffers localized corrosion, that is, the maximum corrosion depth is great, although it exhibits good stress corrosion cracking resistance.

TABLE 1

| | Chemical Composition (% by wt.) | | | | | | | | | | | | |
|---|---|---|---|---|---|---|---|---|---|---|---|---|---|
| Sample | C | Si | Mn | P | S | Ni | Cr | Cu | Mo | N | Al | REM | Remarks |
| A1 | 0.068 | 0.57 | 1.08 | 0.028 | 0.008 | 8.64 | 18.16 | 0.08 | 0.04 | 0.027 | — | — | Comp. |
| A2 | 0.060 | 0.61 | 1.60 | 0.030 | 0.009 | 11.57 | 17.07 | 0.28 | 2.27 | 0.009 | — | — | Steel |
| A3 | 0.044 | 1.92 | 0.94 | 0.020 | 0.007 | 8.72 | 19.12 | 2.14 | <0.01 | 0.013 | — | — | |
| A4 | 0.036 | 1.41 | 0.41 | 0.026 | 0.004 | 10.11 | 18.26 | 1.90 | 1.01 | 0.034 | — | — | |
| A5 | 0.058 | 3.10 | 0.55 | 0.022 | 0.010 | 12.70 | 18.01 | 2.05 | 1.65 | 0.021 | — | — | |
| A6 | 0.043 | 3.28 | 0.47 | 0.033 | 0.008 | 11.78 | 18.46 | 1.88 | <0.01 | 0.083 | — | — | |
| B1 | 0.055 | 2.83 | 0.39 | 0.024 | 0.001 | 10.68 | 18.84 | 1.90 | <0.01 | 0.022 | — | — | Inven- |
| B2 | 0.057 | 2.98 | 0.42 | 0.023 | 0.001 | 12.37 | 18.78 | 1.99 | 0.77 | 0.024 | — | — | tive |
| B3 | 0.057 | 3.15 | 0.43 | 0.026 | 0.001 | 12.44 | 18.65 | 1.94 | <0.01 | 0.023 | 0.08 | 0.05 | Steel |
| B4 | 0.057 | 3.09 | 0.44 | 0.025 | 0.001 | 13.79 | 18.61 | 1.96 | 0.79 | 0.021 | 0.82 | 0.03 | |
| B5 | 0.038 | 3.35 | 0.38 | 0.028 | 0.002 | 12.30 | 18.68 | 3.12 | <0.01 | 0.045 | — | — | |
| B6 | 0.048 | 3.11 | 0.40 | 0.027 | 0.003 | 13.15 | 18.42 | 2.15 | 1.10 | 0.012 | — | — | |
| B7 | 0.040 | 3.21 | 0.28 | 0.025 | 0.001 | 12.85 | 18.33 | 2.07 | <0.01 | 0.008 | 0.15 | — | |

TABLE 2

| | SCC Test | | | | Corrosion Test | |
|---|---|---|---|---|---|---|
| | Auto Clave Test | | | Heat Transfer Surface Test | | |
| | SCC Prevention | Corrosion Depth (120° C.) | | SCC Prevention | Weight | No. of corroded |
| Sample | Limit Temp (°C.) | Max (μ) | Av. (μ) | Limit Temp (°C.) | Loss (mg) | pieces |
| A1 | <80 | 260 | 155 | — | 15.7 | 28 |
| A2 | <80 | 115 | 88 | — | 13.1 | 17 |
| A3 | 120 | 250 | 210 | 200 | 14.6 | 20 |
| A4 | <110 | 110 | 93 | 150 | 7.4 | 9 |
| A5 | 90 | 95 | 72 | 150 | 5.6 | 7 |
| A6 | 120 | 280 | 130 | 200 | 13.0 | 16 |
| B1 | 120 | 115 | 113 | >250 | 12.1 | 7 |
| B2 | 120 | 65 | 60 | 200 | 8.9 | 9 |
| B3 | 140 | 20 | 10 | >250 | 14.5 | 5 |
| B4 | 140 | 20 | 15 | 250 | 10.6 | 9 |
| B5 | 120 | 108 | 95 | >250 | 11.6 | 11 |
| B6 | 110 | 48 | 38 | 200 | 7.6 | 8 |

TABLE 2-continued

| | SCC Test | | | | | |
|---|---|---|---|---|---|---|
| | Auto Clave Test | | | Heat Transfer Surface Test | Corrosion Test | |
| | SCC Prevention | Corrosion Depth (120° C.) | | SCC Prevention | Weight | No. of corroded |
| Sample | Limit Temp (°C.) | Max (μ) | Av. (μ) | Limit Temp (°C.) | Loss (mg) | pieces |
| B7 | 130 | 35 | 28 | >250 | 13.3 | 9 |

We claim:

1. An austenitic stainless steel having excellent corrosion resistance in hot aqueous medium consisting essentially of by weight:

C: not more than 0.06%
Si: 2.8–4.0%
Mn: not more than 0.5%
P: not more than 0.045%
S: not more than 0.005%
Cr: 17–25%
Ni: 10–18%
Cu: 1.5–4.0%
N: not more than 0.04%
Mo: 0.3–1.5% and the balance Fe and unavoidable incidental impurities.

2. The stainless steel as recited in claim 1 which further contains Al: 0.05–3.0%.

3. The stainless steel as recited in claim 1 or 3, which further contains

REM: 0.005–1.1%.

4. The stainless steel as recited in claim 1, wherein
the C content is not more than 0.05%,
the Si content is 3.0–4.0%,
the Mn content is not more than 0.4%,
the Cr content is 18–20%,
the Ni content is 12–16%,
the Cu content is 3.0–4.0%, and
the N content is not more than 0.03%.

5. The stainless steel as recited in claim 1, wherein
the Cr is 17–22%,
the Cu content is 2.0–2.0%, and
the Mo content is 0.3–1.2%.

6. The stainless steel as recited in claim 5, wherein
the C content is not more than 0.05%,
the Si content is 3.0–4.0 %,
the Mn content is not more than 0.4%,
the Cr content is 18–20%,
the Ni content is 12–16%,
the Cu content is 3.0–4.0%, and
the Mo content is 0.3–1.0%, and 7. The stainless steel as recited in claim 2, wherein
the Cr content is 17–22%,
the Cu content is 2.0–4.0%,
the Mo content is 0.3–1.2%,
and the Al content is 0.1–2.0%.

8. The stainless steel as recited in claim 7, wherein
the C content is not more than 0.05%,
the Si content is 3.0–4.0%,
the Mn content is not more than 0.4%,
the Cr content is 18–20%,
the Ni content is 12–16%,
the Cu content is 3.0–4.0%,
the N content is not more than 0.03%,
the Mo content is 0.3–1.0%, and
the Al content is 0.1–1.0.

9. The stainless steel as recited in claim 3, wherein
the Cr content is 17–22%,
the Cu content is 2–4%,
the Mo content is 0.3–1.2%,
the Al content is 0.1–2.0% when contained, and
the REM content is 0.01–0.08%.

10. The stainless steel as recited in claim 9, wherein
the C content is not more than 0.05%,
the Si content is 3.0–4.0%,
the Mn content is not more than 0.4%,
the Cr content is 18–20%,
the Ni content is 12–16%,
the Cu content is 3.0–4.0%,
the N content is not more than 0.03%,
the Mo content is 0.3–1.0%,
the Al content is 0.1–1.0% when contained, and
the REM content is 0.03–0.05%.

* * * * *

UNITED STATES PATENT AND TRADEMARK OFFICE

CERTIFICATE OF CORRECTION

PATENT NO. : 4,933,143

DATED : June 12, 1990

INVENTOR(S) : Toshiro Adachi, Atsushi Fujii, Isamu Yoshimura and Tsuguyasu Yoshii

It is certified that error appears in the above-identified patent and that said Letters Patent is hereby corrected as shown below:

Column 1 Line 16 "chloride" should read --chlorides--.

Column 1 Line 32 "chlorides" should read --chloride--.

Column 1 Line 52 "<" should read --≤--.

Column 1 Line 54 "nor" should read --not--.

Column 1 Line 67 "preceeded" should read --proceeded--.

Column 2 Line 32 after "Si" insert --is--.

Column 3 Line 15 "row" should read --raw--.

Column 3 Line 27 after "has" insert --an--.

Column 3 Line 54 "n" should read --in--.

Column 4 Line 1 "prevent" should read --prevention--.

UNITED STATES PATENT AND TRADEMARK OFFICE

CERTIFICATE OF CORRECTION

PATENT NO. : 4,933,143

DATED : June 12, 1990

INVENTOR(S) : Toshiro Adachi, Atsushi Fujii, Isamu Yoshimura and Tsuguyasu Yoshii

It is certified that error appears in the above-identified patent and that said Letters Patent is hereby corrected as shown below:

Column 4 Line 41 "increased in" should read --increasing--.

Column 4 Line 61 "small" should read --smaller--.

Column 4 Line 62 "was" should read --were--.

Column 6 Line 21 "Samples" should read --Sample--.

Claim 3 Line 30 Column 7 "1.1%" should read --0.1%--.

Claim 5 Line 41 Column 7 "2.0%" should read --4.0%--.

Claim 6 Line 45 Column 7 "4.0 %," should read --4.0%,--.

Claim 6 Line 13 Column 8 delete ", and" and insert --.-- therfor.

Claim 8 Line 28 Column 8 "1.0." should read --1.0%.--.

Signed and Sealed this

Eighth Day of October, 1991

*Attest:*

HARRY F. MANBECK, JR.

*Attesting Officer*

*Commissioner of Patents and Trademarks*